US007218875B2

(12) United States Patent
Baruch et al.

(10) Patent No.: US 7,218,875 B2
(45) Date of Patent: May 15, 2007

(54) APPARATUS AND PROCESS FOR FUSER CONTROL

(75) Inventors: Susan C. Baruch, Pittsford, NY (US); John P. King, Pittsford, NY (US); Borden H. Mills, III, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 134 days.

(21) Appl. No.: 11/087,779

(22) Filed: Mar. 23, 2005

(65) Prior Publication Data

US 2005/0214003 A1 Sep. 29, 2005

Related U.S. Application Data

(60) Provisional application No. 60/556,091, filed on Mar. 24, 2004.

(51) Int. Cl.
*G03G 15/20* (2006.01)

(52) U.S. Cl. ..... 399/69; 399/45

(58) Field of Classification Search ..... 399/45, 399/67, 69; 219/216
See application file for complete search history.

(56) References Cited

U.S. PATENT DOCUMENTS

| | | | | |
|---|---|---|---|---|
| 4,963,943 | A | | 10/1990 | Tamary |
| 5,019,693 | A | | 5/1991 | Tamary |
| 5,204,723 | A | * | 4/1993 | Hanada et al. |
| 5,512,993 | A | * | 4/1996 | Endo et al. |
| 5,787,321 | A | | 7/1998 | Nishikawa et al. |
| 5,905,925 | A | | 5/1999 | Kawabata et al. |
| 5,956,543 | A | | 9/1999 | Aslam et al. |
| 5,956,544 | A | | 9/1999 | Stern et al. |
| 6,011,939 | A | * | 1/2000 | Martin ..... 399/69 |
| 6,121,986 | A | | 9/2000 | Regelsberger et al. |
| 6,377,776 | B1 | | 4/2002 | Orchard, II et al. |
| 6,486,441 | B1 | | 11/2002 | Chen et al. |
| 6,549,745 | B2 | | 4/2003 | May et al. |
| 6,587,652 | B2 | | 7/2003 | Metzler |
| 6,608,641 | B1 | | 8/2003 | Alexandrovich et al. |
| 6,611,670 | B2 | | 8/2003 | Chen et al. |
| 2004/0023144 | A1 | | 2/2004 | Pickering et al. |
| 2004/0028420 | A1 | | 2/2004 | Aslam et al. |
| 2004/0228667 | A1 | * | 11/2004 | Eskey |

FOREIGN PATENT DOCUMENTS

| | | | |
|---|---|---|---|
| JP | 06222694 A | * | 8/1994 |
| WO | 02/01086 | | 1/2002 |
| WO | 02/14957 | | 2/2002 |
| WO | 01/89194 | | 11/2002 |

* cited by examiner

OTHER PUBLICATIONS

U.S. Appl. No. 10/668,416, "Air Baffle for Paper Travel Path Within an Electrophotographic Machine," filed Sep. 23, 2003, Giannetti, et al.

*Primary Examiner*—Susan Lee
(74) *Attorney, Agent, or Firm*—Donna P. Suchy

(57) ABSTRACT

The invention is in the field of fusing and fusing apparatus for print media, particularly for fusing toner to print media and other variations. According to various aspects of the invention, an improved temperature control is provided for a fusing apparatus wherein control is prioritized. According to various further aspects of the invention, a device having a fuser controller is provided operative to control a fusing control parameter based at least in part upon a print media thickness. Numerous other variations and aspects are included within the scope of the invention.

9 Claims, 9 Drawing Sheets

APPARATUS AND PROCESS FOR FUSER CONTROL

CROSS REFERENCE TO RELATED APPLICATIONS

This is a 111A application of Provisional Application Ser. No. 60/556,091, filed Mar. 24, 2004, entitled APPARATUS AND PROCESS FOR FUSER CONTROL by Susan C. Baruch, et al.

BACKGROUND OF THE INVENTION

The invention is in the field of fusing and fusing apparatus for print media, particularly for fusing toner to print media and other variations.

Fusers are commonly implemented in electrographic print systems to fix toner, for example, to a print media such as a sheet of paper or plastic. Fuser temperature may be maintained by a feedback control loop that senses fuser roller surface temperature and turns heater lamps on and off in a pulse-width-modulated duty cycle to maintain roller temperature at a setpoint. At the beginning of a run, if the system has been in standby mode, fuser roller temperature is at, or very near, the desired setpoint. During the run, fuser roller temperature will undergo a transient decline, reaching a minimum and then begin to recover, eventually coming back up to the setpoint. During the transient, fuser roller temperature can fall to a level where fusing quality is compromised with reduced adhesion of the toner and increased crack-width in the fused toner. The amount of this transient "droop" depends on the heat capacity of the receiver, which in turn depends on the specific heat and mass of the receiver sheet.

Heavy coated papers represent a worst case due to greater mass and specific heat. One control scheme uses proportional-integral control with added feed-forward compensation to try to anticipate the transient droop and compensate by adding additional heat. The feed-forward is open loop since there is no sensor to measure heat removed by the receiver. An improved apparatus and control system is desired.

DETAILED DESCRIPTION OF THE INVENTION

Figure 1:
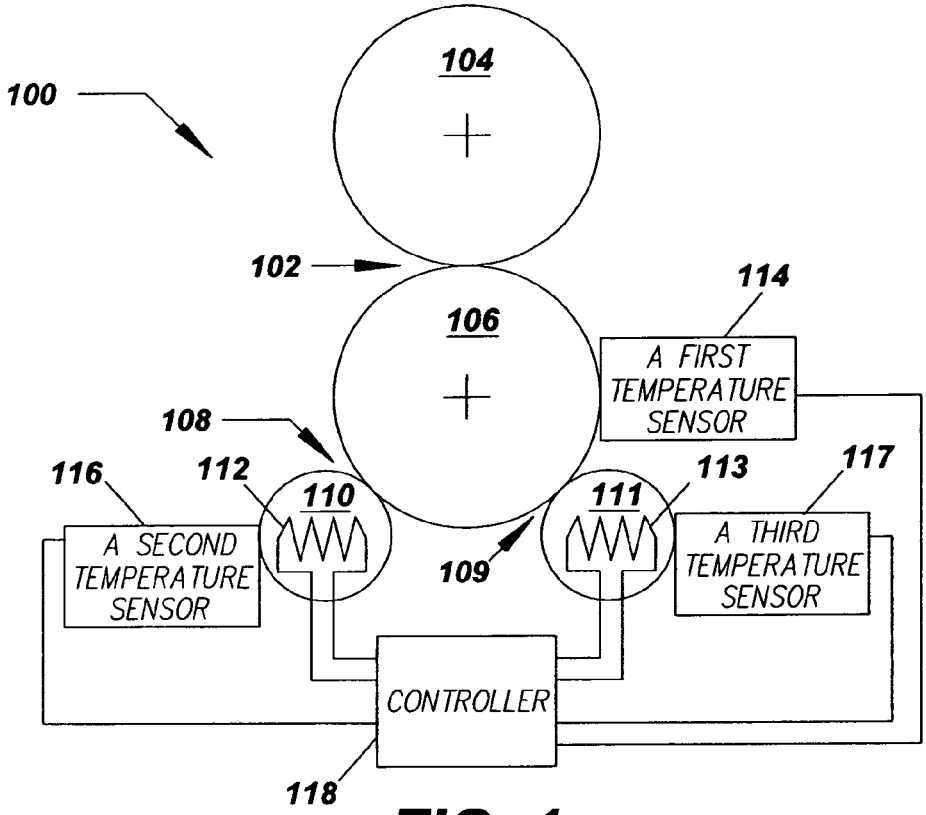
FIG. 1 is a schematic representation (end view) of a fuser assembly according to an aspect of the invention.
Figure 2:
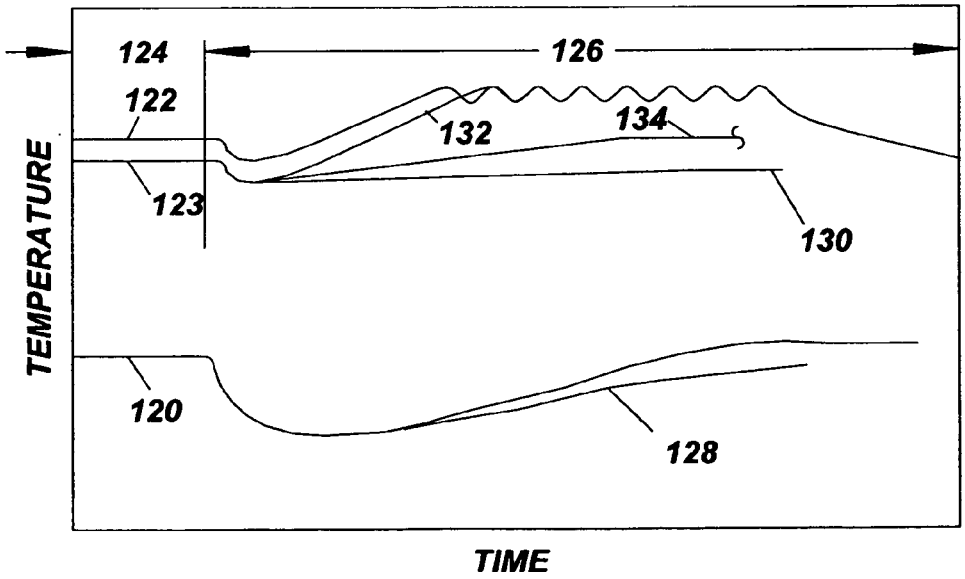
FIG. 2 is a plot of temperature versus time according to an aspect of the invention.

Various aspects of the invention are presented in FIGS. 1–15, which are not drawn to any particular scale, and wherein like components in the numerous views are numbered alike. Referring now to FIGS. 1 and 2, a fusing apparatus 100 and process for an electrographic printer comprising a fusing nip 102 comprising two rollers 104 and 106, and at least one heating nip 108. A print media is fed through the fusing nip 102, as is well known in the art. The heating nip 108 comprises a heater roller 110 and a first of the rollers 106, and the heater roller 110 comprises a heat source 112. A first temperature sensor 114 operative to sense a roller temperature 120 of the first of the rollers 106 is provided, a second temperature sensor 116 operative to sense a heater roller temperature 122 of the heater roller 110 is provided. A controller 118 is provided, the controller 118 being operative to regulate the roller temperature 120 while limiting a maximum heater roller temperature through interaction with the heat source 112 and with input from the first temperature sensor 114 and the second temperature sensor 116.

In FIG. 2, there is a standby 124 prior to print media being fed to the fusing nip 102 for fusing wherein the heater roller temperature 122 is in a steady-state. The standby 124 may correspond to the heater roller temperature 122 being a temperature setpoint for fusing. A run 126 follows the standby 124 wherein a stream of print media is fed to the fusing nip 102. Generally, at the end of run 126, the fuser assembly 100 returns to standby 124. During run 126, the stream of print media draws a substantial quantity of heat energy out of the first of the rollers 106 causing an effect known as "temperature droop", represented as the substantial dip in roller temperature 120. The controller 118 responds by switching power on to the heat source 112 and the heater roller temperature 122 may increase (depending on the amount of heat transferred to the print media) until a time is reached wherein the controller 118 regulates the heater roller temperature 122. Since, the controller 118 is operative to limit the heater roller temperature 122 while controlling the roller temperature 120, the roller temperature 120 may not rise as quickly, indicated in FIG. 2 by temperature plot 128, since the controller 118 effectively caps the quantity of heat energy that heater roller 110 can deliver to the first of the rollers 106. However, a quick rise in roller temperature 120 is still desired in order to minimize droop. If the fuser is still unable to transfer sufficient heat, as determined by the roller temperature 120, skip frames can be added to the printing process ("skip frames" are a temporary reduction in printing rate, on a page-by-page basis, where no paper is passed through the fuser).

An advantage with this control scheme lies in regulating the heater roller temperature 122, and indirectly the heat source 112. Preferably, the controller 118 is operative to prevent the heater roller temperature 122 from exceeding a predetermined maximum heater roller temperature, which may prevent damage to the heater roller or burn-out of the heat source 112, which may be a heat lamp, for example (of course other suitable heaters may be implemented, particularly electrothermal heaters). The effect of the controller 118 capping the quantity of heat energy that the heater roller 110 can deliver to the first of the rollers 106 may be offset by configuring the fuser assembly 100 to supply sufficient heat energy for a range of expected print media stocks. Thus, faster recovery from droop may be provided while also providing better control of the heat source 112.

According to one embodiment, although not so limited, the controller 118 switches power on to the heat source 112 until the heater roller temperature 122 reaches a maximum heater roller temperature, and then the controller 118 switches power off to the heat source 112. In response, the roller temperature 120 continues to increase but at a slower rate, the heater roller temperature 122 decreases and the controller switches power on and off to the heat source 112 cyclically until the roller temperature 120 reaches a controlled temperature at the temperature setpoint for fusing.

Still referring to FIGS. 1 and 2, and according to a further embodiment, another heating nip 109 may be provided comprising another heater roller 111 and the first of the rollers 106. The another heater roller 111 comprises another heat source 113. A third temperature sensor 117 is provided operative to sense another heater roller temperature of the another heater roller 111. The controller 118 is operative to control the roller temperature while limiting the another heater roller temperature 123 of the another heater roller 111 through interaction with the another heat source 113. The controller 118 is in communication with the third temperature sensor 117. The controller 118 may be operative to regulate the roller temperature 120 while limiting another maximum heater roller temperature through interaction with the heat source 112 and with input from the first temperature sensor 114 and the third temperature sensor 117, analogous to the control of the heater roller temperature 122 as previously described herein, and as shown by temperature plot 132. The controller 118 may be operative to prevent the another heater roller temperature 123 from exceeding another predetermined maximum heater roller temperature.

The controller 118 may be operative to establish a heating power ratio between the heat source 112 and the another heat source 113. Temperature plot 134 represents the another heater roller temperature 123 for a desired heating power ratio. The desired heating power ratio may not be achieved, as indicated by temperature plots 130 and 132, since regulating the temperature of the roller 106 and the temperatures of the heat sources 112 and 113 may be a greater priority. Temperature plot 130 is an example where not as much heat power is needed to fuse the print media. Temperature plot 132 is an example where more heat power is needed to fuse the print media. Overall, the system is more responsive and flexible compared to prior art systems. Of course, there are many possible variations in the temperature plots and these examples are representative only to assist in understanding.

According to one embodiment, the two rollers 104 and 106 comprise a pressure roller and a fuser roller, respectively, the first of the rollers 106 being the fuser roller. The roller temperature is a surface temperature of the first of the rollers 106, the heater roller temperature 122 is a surface temperature of the heater roller 110, and the another heater roller temperature 123 is a surface temperature of the another heater roller 111.

Figure 3:
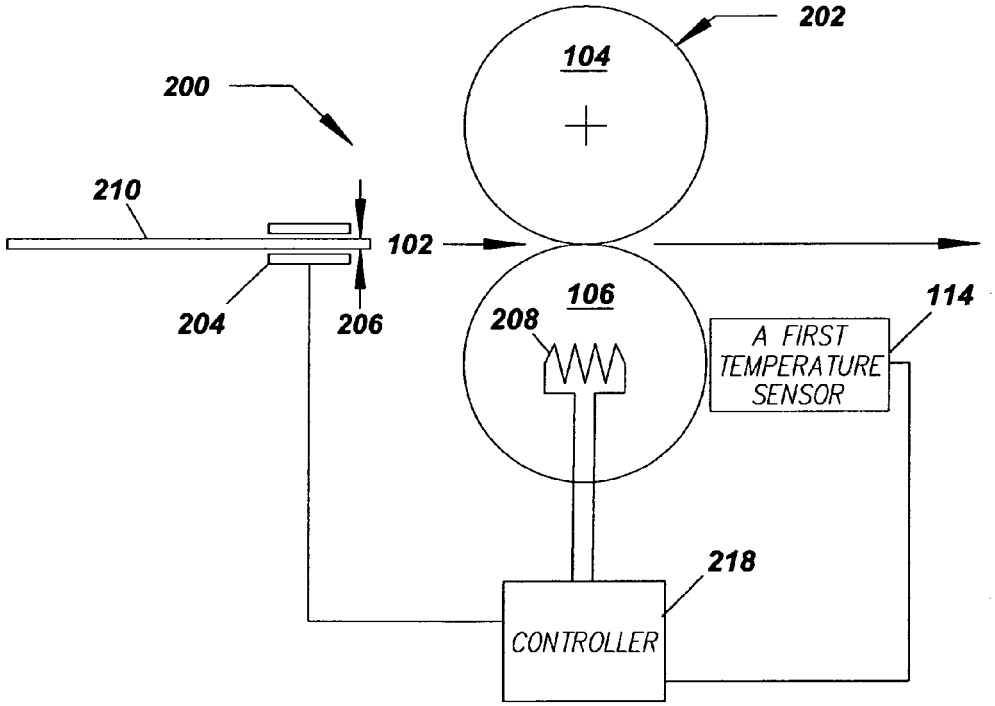
FIG. 3 is a schematic representation (end view) of a fuser assembly according to a further aspect of the invention.
Figure 4:
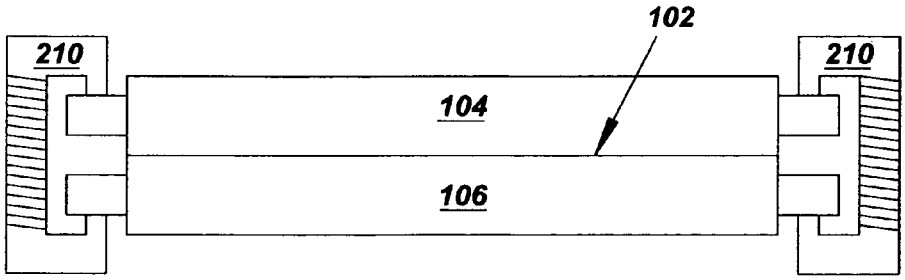
FIG. 4 is a schematic representation (side view) of a fuser assembly according to a further aspect of the invention.

Referring now to FIG. 3, an apparatus 200 and process is presented according to a further aspect of the invention. Apparatus 200 comprises a fuser assembly 202 operative to fuse print media 210, a thickness sensor 204 operative to sense a print media thickness 206, and a controller 218 operative to control a fusing control parameter based at least in part upon the print media thickness 206. The fuser assembly 202 may comprise a heat source 208, and the at least one fusing control parameter may comprise heat power applied to the heat source 208. The at least one fusing control parameter may also comprise a temperature setpoint for a temperature related to fusing in the fuser assembly 202, for example the surface temperature of the roller 106. As shown in FIG. 4, the fuser assembly 202 may comprise a loading mechanism operative to establish a fusing force in the fusing nip 102 (forcing the rollers 104 and 106 toward each other), and the at least one fusing control parameter may comprise the fusing force. The loading mechanism 210 may comprise any suitable mechanism for generating a fusing force, for example screws, cams, levers, pneumatics, hydraulics, and electromechanical devices (including motors and stepper motors).

Changing the fusing force may influence the temperature of certain components in the fuser assembly. For example, referring again to FIG. 2, reducing the fusing force during standby 124 tends to reduce wear on the rollers 106 and 104 and also tends to increase the heater roller temperature 122 and/or 123. The fusing force may be increased just prior to the run 126.

The thickness sensor 204 may be a multi-feed sensor located upstream from the fuser assembly (as shown in FIG. 3). A multi-feed sensor may also be used to detect multiple feeds of print media from a media supply, and also includes the ability to sense the thickness of a single print medium. Multi-feed sensors are well known in the art.

Referring again to FIG. 3, the controller 218 may be operative to vary heating of the at least one heated roller 106 based at least in part upon the print media thickness 206 in advance of print media 210 reaching the fusing nip. According to one embodiment, the controller 218 is operative to regulate a fusing temperature of the at least one heated roller 106 according to a fusing setpoint temperature; the controller being operative to increase the fusing setpoint temperature in response to an increase in the print media thickness 206. According to another embodiment, the controller 218 is operative to regulate a fusing temperature of the at least one heated roller 106 according to a fusing setpoint temperature; the controller 218 being operative to decrease the fusing setpoint temperature in response to a decrease in the print media thickness 206. The controller 218 may be operative to do both. The fusing setpoint temperature may be a function of the print media thickness 206.

The controller 218 may be operative to increase heating power in response to an increase in the print media thickness 206. According to another embodiment, the controller 218 is operative to decrease heating power in response to a decrease in the print media thickness 206. The controller 218 may be operative to do both. The heating power may be a function of the print media thickness 206.

The fusing nip 102 may comprise a heated roller 106, the controller being operative to increase heating power to the heated roller 106 in response to an increase in the print media thickness 206. According to another embodiment, the fusing nip 102 comprises a heated roller 106, the controller 218 being operative to decrease heating power to the heated roller 106 in response to a decrease in the print media thickness 206. The controller 218 may be operative to do both. The heating power may be a function of the print media thickness 206.

Figure 5:
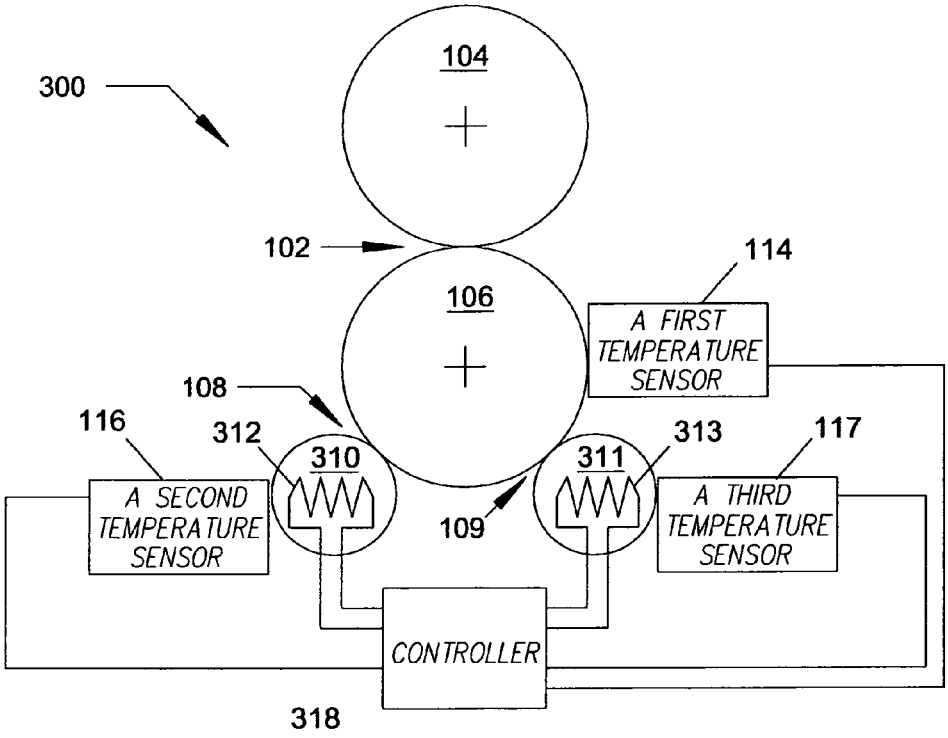
FIG. 5 is a schematic representation (end view) of a fuser assembly according to a further aspect of the invention.
Figure 6:
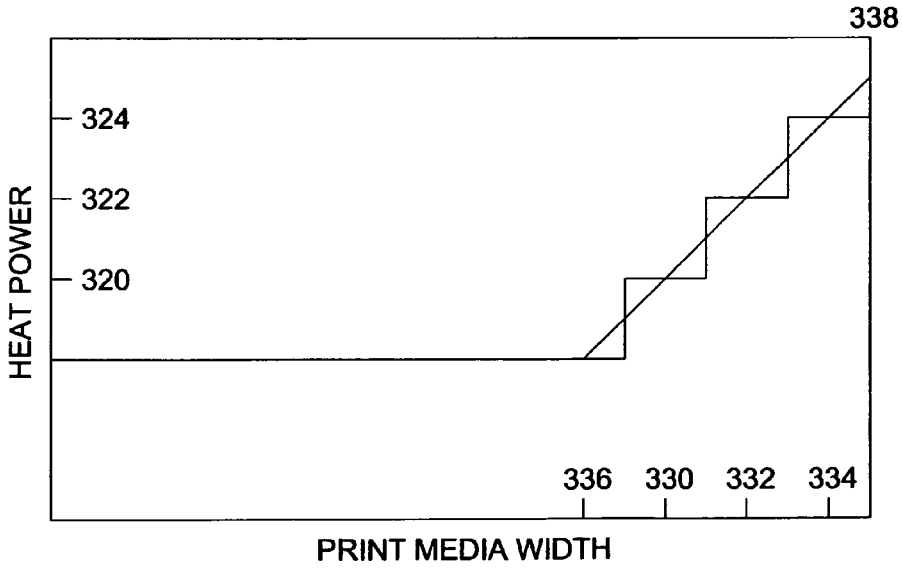
FIG. 6 is a plot of heat power versus print media width according to further aspect of the invention.

Referring now to FIGS. 5 and 6, a fusing apparatus 300 and a process for an electrographic printer according to a further aspect of the invention is presented. The fusing apparatus 300 is similar to apparatus 100 and comprises a heater roller 310 with a heat source 312, and a controller 318 operative to establish a heating power for the heat source 312 dependent upon a print media width. At least three heating powers 320, 322, 324, corresponding to at least three print media widths 330, 332, 334, are provided. According to one embodiment, the controller 318 is operative to increase the heating power with an increase in print media width. According to another embodiment, the controller 318 is operative to decrease the heating power with a decrease in print media width. The controller 318 may be operative to do both.

Figure 8:
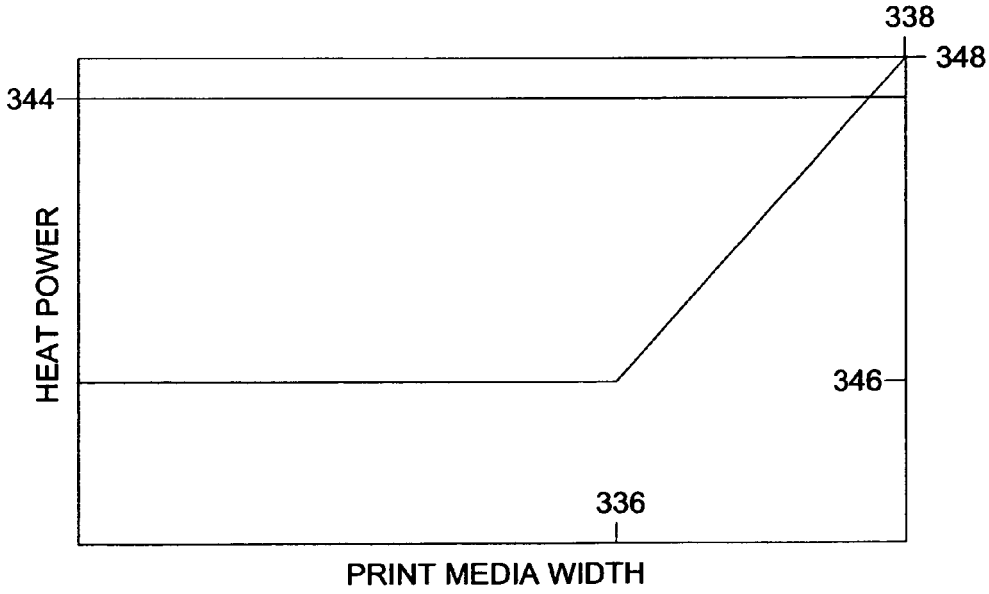
FIG. 8 is a plot of heat power versus print media width according to further aspect of the invention.

Referring now to FIG. 8, the controller 318 may be operative to linearly increase the heating power from a first heating power 346 to a second heating power 348 with an increase in print media width from a first print media width 336 to a greater second print media width 338. The controller may be operative to linearly decrease the heating power with a decrease in print media width from a second print media width to a lesser first print media width. The controller 318 may be operative to do both.

Figure 7:
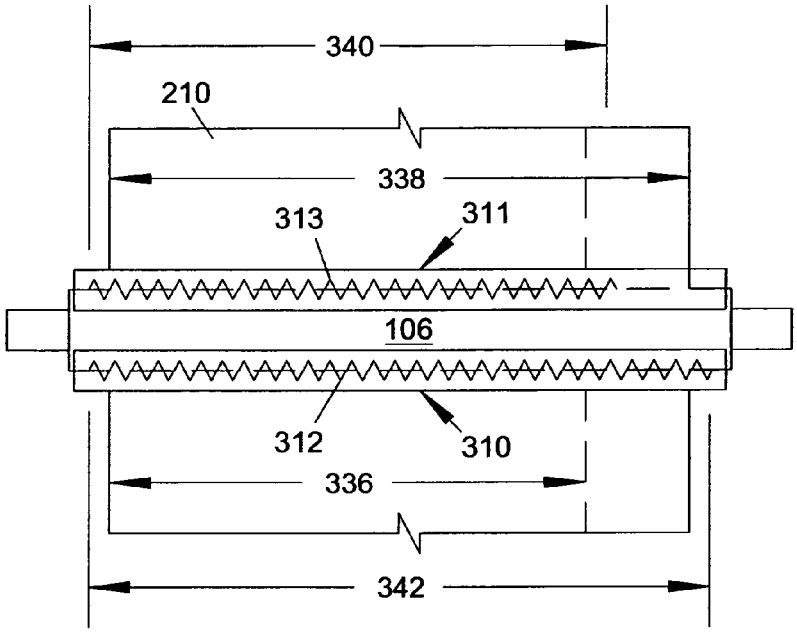
FIG. 7 is a bottom view of the FIG. 5 fuser assembly showing the heater rollers.

Referring now FIGS. 5 and 7, the heat source 312 within the heater roller 310 has an operable width 342 (over which the heat source 312 generates heat). Another heater roller 311 may be provided comprising another heat source 313, the another heat source 313 having another operable width 340 (over which the heat source 313 generates heat), the operable width 342 being greater than the another operable width 340. Referring again to FIG. 8, the controller 318 may be operative to establish another heating power 344 for the another heat source 313 not dependent upon the print media width. The another heating power 344 may be constant, for example.

Figure 9:
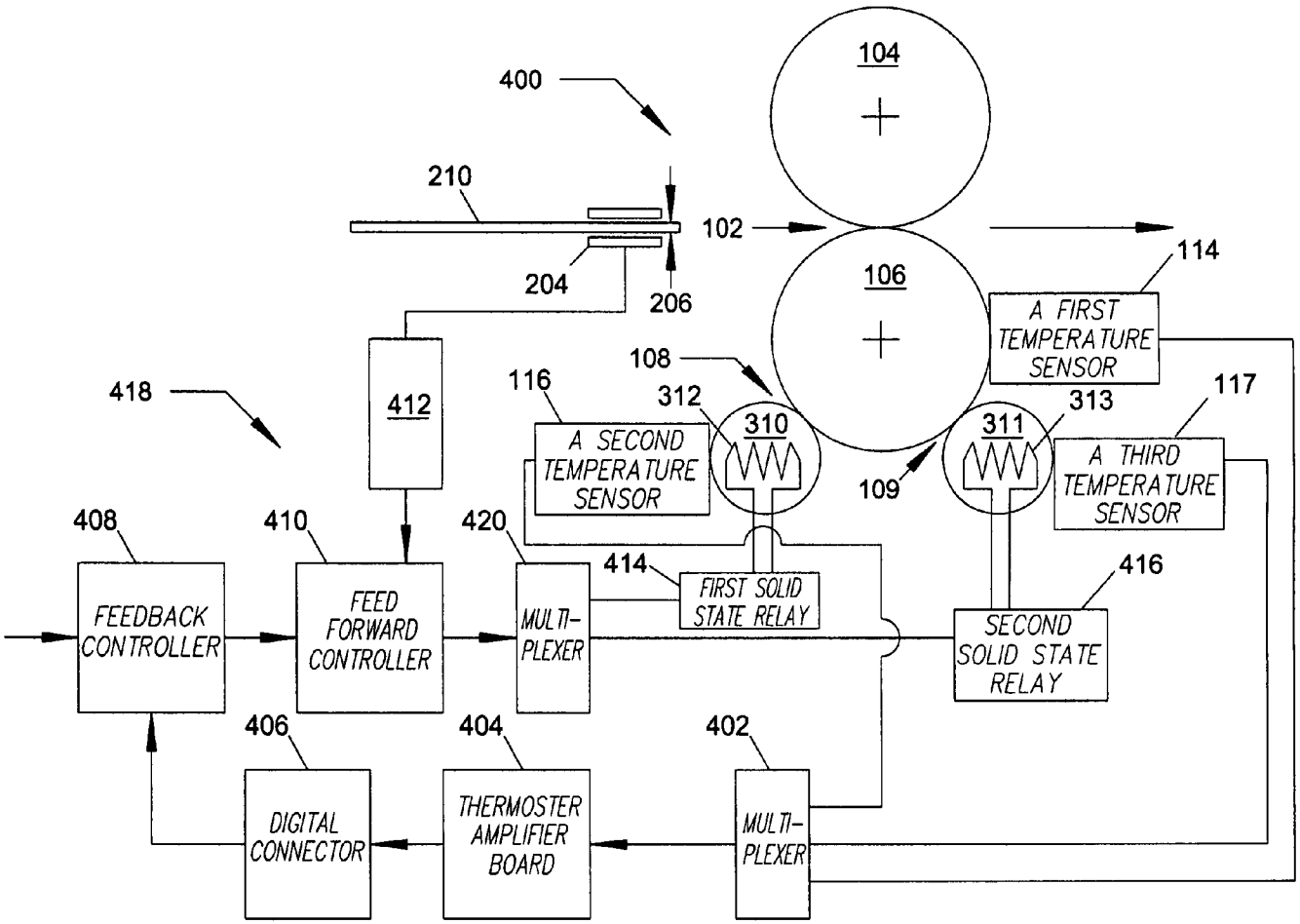
FIG. 9 is a schematic representation of an embodiment having a distributed control system.

Referring now to FIG. 9, an embodiment is presented comprising a fusing apparatus 400 and a process comprising a distributed controller 418. Output from the temperature sensors 114, 116 and 117 is multiplexed by a multiplexer 402 to a thermistor amplifier board 404. Output from the thermistor amplifier board is communicated to an analog to digital converter 406 and then to a feedback controller 408 that processes the information and communicates with a feed forward controller 410. Output from the thickness sensor 204 is communicated to an analog to digital converter 412 and then to the feed forward controller 410. Output from the feed forward controller is communicated to a first solid state relay 414 and a second solid state relay 416 that switch power to the heat source 312 and the another heat source 313 through a multiplexer 420.

Figure 10:
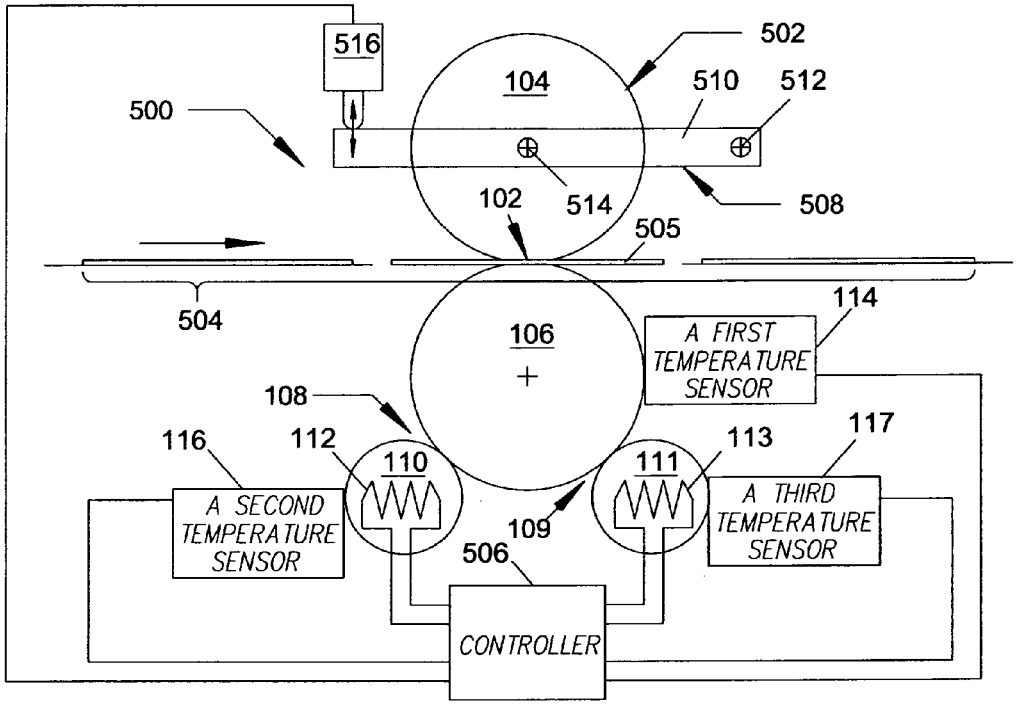
FIG. 10 is a schematic representation (end view) of a fuser assembly according to a further aspect of the invention.

Referring now to FIG. 10 an embodiment comprising a fusing apparatus 500 and a process is presented comprising moving a stream of print media 504 through a fuser assembly 502, and changing at least one fusing control parameter while the stream of print media 504, all of a same type, is moving through the fuser assembly 502. A controller 506 may be provided that is operative to change the at least one fusing control parameter in accordance with this process. In the example presented in FIG. 10, the fuser assembly 502 comprises the two rollers 104 and 106. The stream of print media 504 be a single stream, or one of a plurality of streams of print media. For example, a stream of print media 504, all of a same type, may precede or follow a stream of print media 504, all of a same another type. One or more print media of another type may be intermingled between streams, and/or placed at the beginning and/or end of a stream. As used herein, the term "stream" means at least two sheets, and may comprise at least three sheets, at least four sheets, or a multitude of sheets.

The process may comprise changing the fusing control parameter between ends (a leading edge and a trailing edge) of a single print media 505. This may be implemented by the controller being operative to change the fusing control parameter in the manner just described.

The process may also comprise changing the fusing control parameter while the stream of print media 504, all of the same type, is moving through the fuser assembly, based at least in part on a thickness of the print media, the size of the print media, and/or the bending stiffness of the print media. Again, this may be implemented by the controller 506 being operative to change the fusing control parameter in the manner just described.

The fusing assembly 502 may comprise the fusing nip 102 having a fusing force, the at least one fusing parameter being the fusing force. For example, the fusing force may be decreased from a beginning of the stream of print media 504 to an end of the stream of print media 504 (e.g. 90 to 100% of max load at the beginning, 75 to 85% of max load at the end). This may be implemented by the controller 506 being operative to decrease the fusing force concurrently with the stream of print media 504. This process may compensate for heating and thermal expansion of the fuser roller over the length of a run, and minimize wrinkling of prints at the beginning of a run, maintain adequate nip load for good fusing quality during thermal droop, and then minimize image defects ("slapdown" or "lakes") due to excessive differential overdrive at the end of the run. The process may also comprise monotonically decreasing the fusing force concurrently with the stream of print media 504.

Alternatively or in addition, the process may comprise increasing fusing force upon a fusing temperature decreasing to a predetermined temperature. This may at least partially compensate for the decreased fusing temperature and provide suitable fusing, especially during thermal droop. Again, this may be implemented by the controller 506 being operative to increase the fusing force upon the fusing temperature decreasing to the predetermined temperature.

Still referring to FIG. 10, an example of a fusing nip loading mechanism 508 is presented comprising a lever 510 that rotates about a fixed pivot 512. The roller 104 is mounted to the lever at a pivot 514. An actuator 516 applies a variable load to the lever under the control of the controller 506. The actuator 516 may comprise any suitable mechanism for generating a fusing force, for example screws, cams, levers, pneumatics, hydraulics, and electromechanical devices (including motors and stepper motors).

The roller 106 may be a fuser roller, and the roller 104 may be a pressure roller, the fuser roller having a cross-sectional diameter that is constant along a length of the fuser roller. In some prior fusing systems, it has been advantageous to vary the pressure exerted by the pressure member against the receiver sheet and fuser member. This variation in pressure can be provided, for example in a fusing system having a pressure roller and a fuser roller, by slightly modifying the shape of the fuser roller and/or pressure roller. The variance of pressure, in the form of a gradient of pressure that changes along the direction through the nip that is parallel to the axes of the rollers, can be established, for example, by continuously varying the overall diameter of the fuser roller and/or pressure roller along the direction of its axis such that the diameter is smallest at the midpoint of the axis and largest at the ends of the axis, in order to give the fuser roller and/or pressure roller a subtle "bow tie" or "hourglass" shape. This causes the pair of rollers to exert more pressure on the receiver sheet in the nip in the areas near the ends of the rollers than in the area about the midpoint of the rollers. This gradient of pressure helps to prevent wrinkles and cockle in the receiver sheet as it passes through the nip. A fuser roller is disclosed in United patent application Publication US 2004/0023144 A1, filed Aug. 4, 2003, in the names of Jerry A. Pickering and Alan R. Priebe, the contents of which are incorporated by reference as if fully set forth herein. Changing the fusing force over the stream of print media may eliminate the need for changing the diameter of the fuser roller and/or pressure roller along the direction of its axis.

Figure 11:
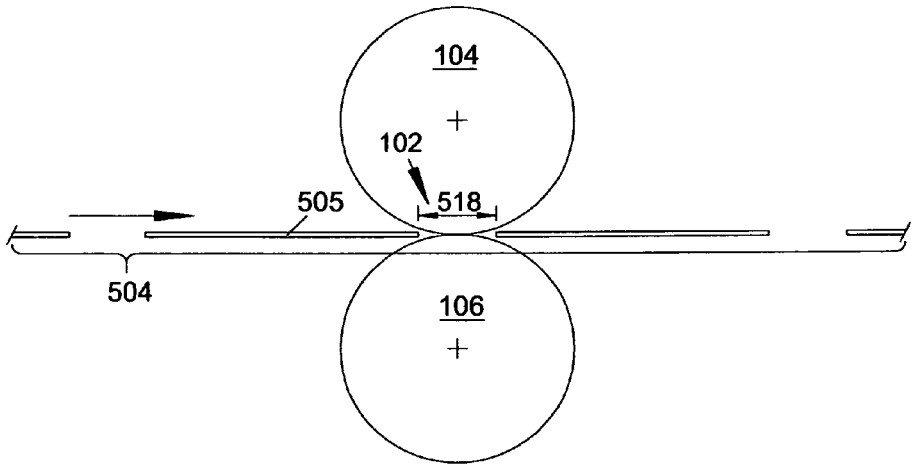
FIG. 11 presents a process according to an aspect of the invention.

Still referring to FIG. 10, an embodiment is presented comprising moving a print medium 505 through the fusing nip 102 comprising the fusing force, and changing the fusing force while the print medium 505 is moving through the fusing nip 102. The process may comprise decreasing the fusing force before, during, or after the print medium 505 enters the fusing nip, and subsequently increasing the fusing nip load force while the print medium 505 is within the fusing nip 102. The process may comprise decreasing the fusing force before, during, or after the print medium 505 leaves the fusing nip. More specifically, and as shown in FIG. 11, the process may comprise decreasing the fusing force in an interframe gap 518 within the fusing nip 102 immediately before the print medium 505, and subsequently increasing the fusing force while the print medium 505 is within the fusing nip 102, and decreasing the fusing force as the print medium leaves the fusing nip 102. Referring again to FIG. 10, the fusing force may be gradually increased to a predetermined fusing force for the balance of the print medium 505 while the print medium 505 is within the fusing nip 102. Very thick print media engenders a rapid change in fuser drive torque, as presented FIG. 14 (LE indicates the leading edge of the print medium and TE indicates the-trailing edge of the print medium), in order to maintain the match between print media velocity and imaging member velocity. Under some conditions, the fuser drive servo may not have sufficient bandwidth to maintain the speed match during this nip entry transient. If the print medium velocity falls behind imaging member velocity, relative motion at the sheet/member interface will cause image smear in the transfer nip. The processes just described enable a gradual change in drive torque preferably within the bandwidth of the drive servo thus minimizing transfer smear of prints when printing on thick sheets.

Figure 15:
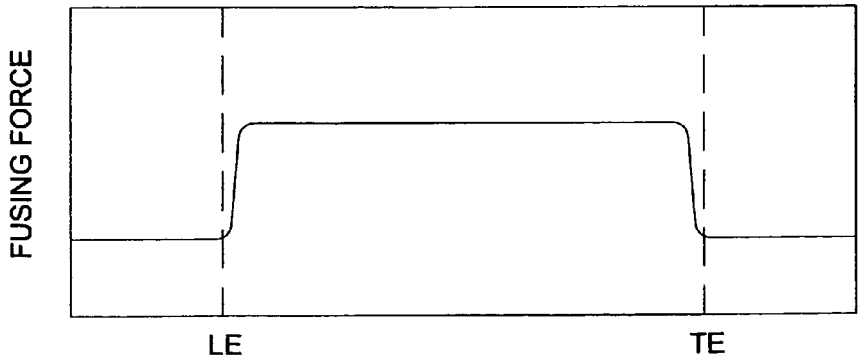
FIG. 15 presents a plot of fusing force versus time.

An example of a fusing force profile is presented in FIG. 15. The fusing force before and after TE and LE is of a magnitude that permits the print medium velocity to match the imaging member velocity as the print medium enters the fusing nip. The fusing force applied over the bulk of the print medium between TE and LE is sufficient for adequate fusing, 400 pounds in one example.

The fusing force between ends (a leading edge and a trailing edge) of the print medium 505 may be changed while the print medium 505 is moving through the fusing nip 102 based at least in part on a thickness of the print medium 505, a size of the print medium 505, or a bending stiffness of the print medium 505. The thickness sensor 204 (FIG. 3) may be implemented to sense a thickness of the print medium 505, and the fusing force between ends (a leading edge and a trailing edge) of the print medium 505 may be changed while the print medium 505 is moving through the fusing nip 102 based at least in part on the thickness of the print medium sensed by the thickness sensor 204. The thickness sensor 204 may be a multi-feed sensor located upstream from the fusing nip 102.

As previously described, these processes may be implemented by the controller 506 being operable to perform one or more steps.

Figure 12:
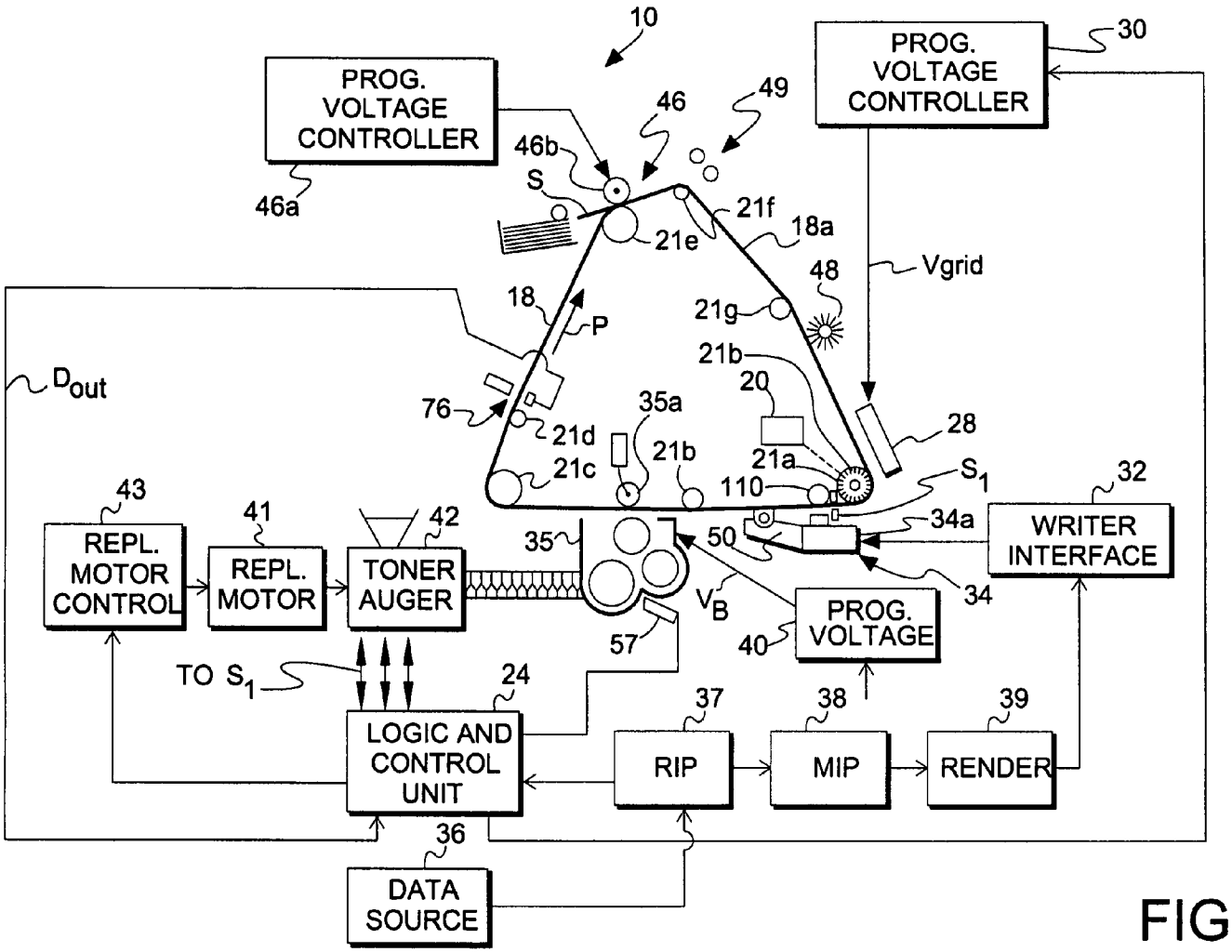
FIGS. 12 and 13 present schematic diagrams of an electrographic marking or reproduction system in accordance with the present invention.
Figure 13:
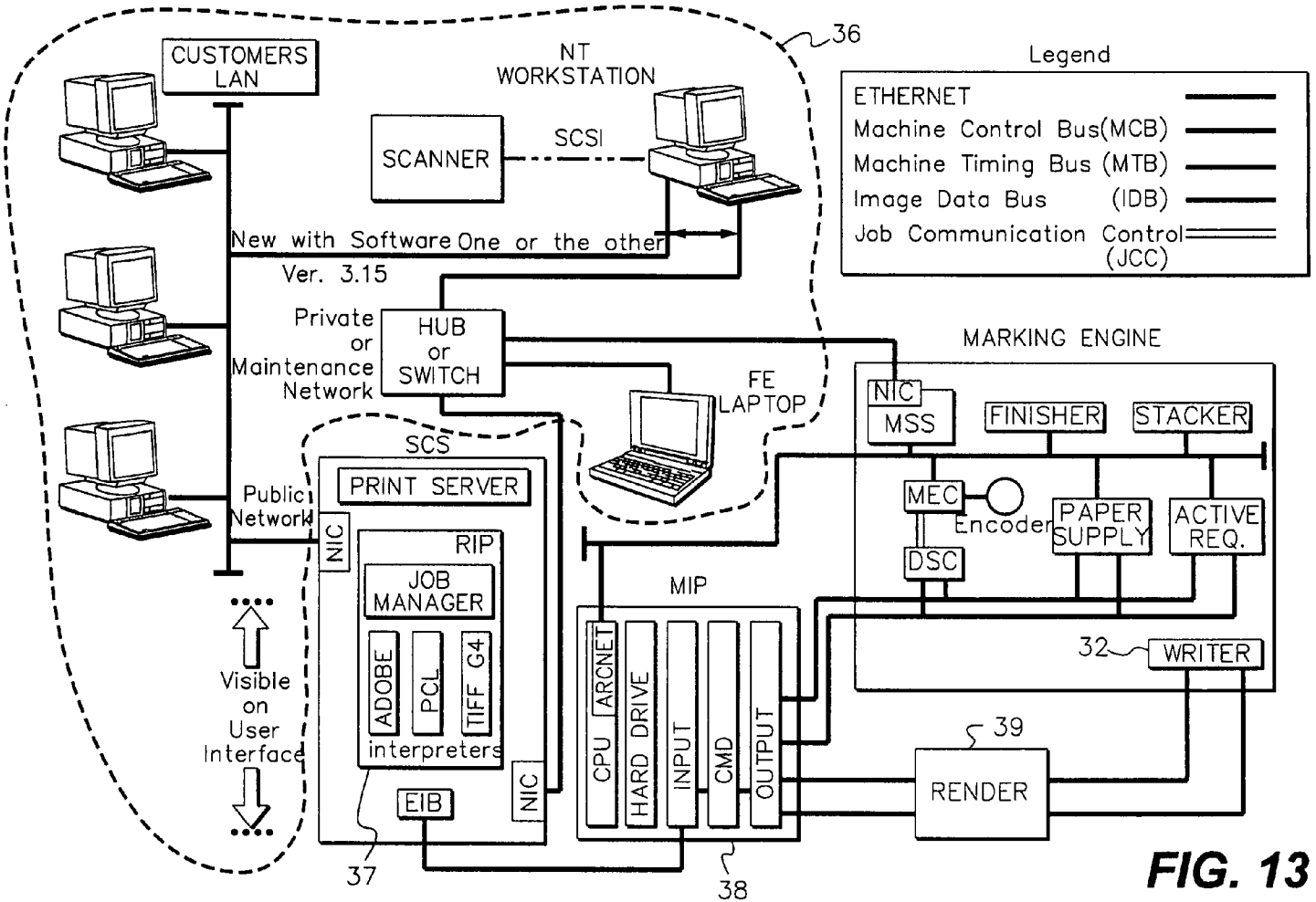
Figure 14:
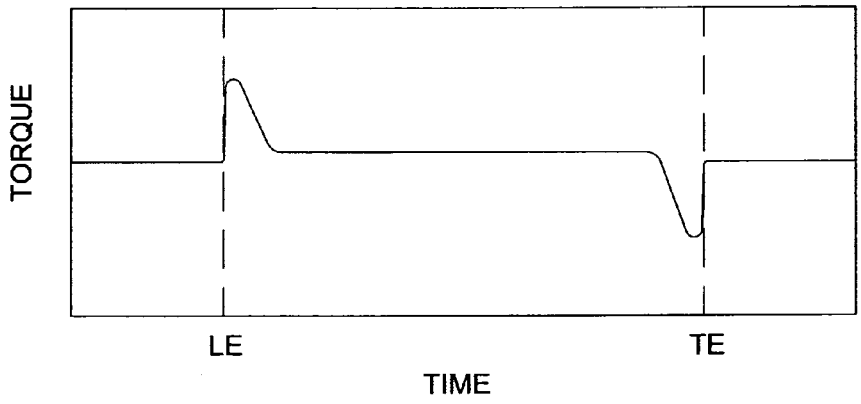
FIG. 14 presents a plot of torque versus time for a fuser roller.

Referring now to FIGS. 12 and 13, a printer machine 10 that implements the fusing apparatus and processes of the invention includes a moving electrographic imaging member 18 such as a photoconductive belt which is entrained about a plurality of rollers or other supports 21*a* through 21*g*, one or more of which is driven by a motor to advance the belt. By way of example, roller 21*a* is illustrated as being driven by motor 20. Motor 20 preferably advances the belt at a high speed, such as 20 inches per second or higher, in the direction indicated by arrow P, past a series of workstations of the printer machine 10. Alternatively, belt 18 may be wrapped and secured about only a single drum, or may be a drum.

Printer machine 10 includes a controller or logic and control unit (LCU) 24, preferably a digital computer or microprocessor operating according to a stored program for sequentially actuating the workstations within printer machine 10, effecting overall control of printer machine 10 and its various subsystems. LCU 24 also is programmed to provide closed-loop control of printer machine 10 in response to signals from various sensors and encoders (e.g. 57, 76) Aspects of process control are described in U.S. Pat. No. 6,121,986 incorporated herein by this reference.

A primary charging station 28 in printer machine 10 sensitizes belt 18 by applying a uniform electrostatic corona charge, from high-voltage charging wires at a predetermined primary voltage, to a surface 18*a* of belt 18. The output of charging station 28 is regulated by a programmable voltage controller 30, which is in turn controlled by LCU 24 to adjust this primary voltage, for example by controlling the electrical potential of a grid and thus controlling movement of the corona charge. Other forms of chargers, including brush or roller chargers, may also be used.

An exposure station 34 in printer machine 10 projects light from a writer 34*a* to belt 18. This light selectively dissipates the electrostatic charge on photoconductive belt 18 to form a latent electrostatic image of the document to be copied or printed. Writer 34*a* is preferably constructed as an array of light emitting diodes (LEDs), or alternatively as another light source such as a laser or spatial light modulator. Writer 34*a* exposes individual picture elements (pixels) of belt 18 with light at a regulated intensity and exposure, in the manner described below. The exposing light discharges selected pixel locations of the photoconductor, so that the pattern of localized voltages across the photoconductor corresponds to the image to be printed. An image is a pattern of physical light which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

Image data to be printed is provided by an image data source 36, which is a device that can provide digital data defining a version of the image. Such types of devices are numerous and include computer or microcontroller, computer workstation, scanner, digital camera, etc. These data represent the location and intensity of each pixel that is exposed by the printer. Signals from data source 36, in combination with control signals from LCU 24 are provided to a raster image processor (RIP) 37. The Digital images (including styled text) are converted by the RIP 37 from their form in a page description language (PDL) to a sequence of serial instructions for the electrographic printer in a process commonly known as "ripping" and which provides a ripped image to a image storage and retrieval system known as a Marking Image Processor (MIP) 38.

In general, the major roles of the RIP 37 are to: receive job information from the server; parse the header from the print job and determine the printing and finishing requirements of the job; analyze the PDL (Page Description Language) to reflect any job or page requirements that were not stated in the header; resolve any conflicts between the requirements of the job and the Marking Engine configuration (i.e., RIP time mismatch resolution); keep accounting record and error logs and provide this information to any subsystem, upon request; communicate image transfer requirements to the Marking Engine; translate the data from PDL (Page Description Language) to Raster for printing; and support diagnostics communication between User Applications The RIP accepts a print job in the form of a Page Description Language (PDL) such as PostScript, PDF or PCL and converts it into Raster, a form that the marking engine can accept. The PDL file received at the RIP describes the layout of the document as it was created on the host computer used by the customer. This conversion process is called rasterization. The RIP makes the decision on how to process the document based on what PDL the document is described in. It reaches this decision by looking at the first 2K of the document. A job manager sends the job information to a MSS (Marking Subsystem Services) via Ethernet and the rest of the document further into the RIP to get rasterized. For clarification, the document header contains printer-specific information such as whether to staple or duplex the job. Once the document has been converted to raster by one of the interpreters, the Raster data goes to the MIP 38 via RTS (Raster Transfer Services); this transfers the data over a IDB (Image Data Bus).

The MIP functionally replaces recirculating feeders on optical copiers. This means that images are not mechanically rescanned within jobs that require rescanning, but rather, images are electronically retrieved from the MIP to replace the rescan process. The MIP accepts digital image input and stores it for a limited time so it can be retrieved and printed to complete the job as needed. The MIP consists of memory for storing digital image input received from the RIP. Once the images are in MIP memory, they can be repeatedly read from memory and output to the Render Circuit. The amount of memory required to store a given number of images can be reduced by compressing the images; therefore, the images are compressed prior to MIP memory storage, then decompressed while being read from MIP memory.

The output of the MIP is provided to an image render circuit 39, which alters the image and provides the altered image to the writer interface 32 (otherwise known as a write head, print head, etc.) which applies exposure parameters to the exposure medium, such as a photoconductor 18.

After exposure, the portion of exposure medium belt 18 bearing the latent charge images travels to a development station 35. Development station 35 includes a magnetic brush in juxtaposition to the belt 18. Magnetic brush development stations are well known in the art, and are preferred in many applications; alternatively, other known types of development stations or devices may be used. Plural development stations 35 may be provided for developing images in plural colors, or from toners of different physical characteristics. Full process color electrographic printing is accomplished by utilizing this process for each of four toner colors (e.g., black, cyan, magenta, yellow).

Upon the imaged portion of belt 18 reaching development station 35, LCU 24 selectively activates development station 35 to apply toner to belt 18 by moving backup roller or bar 35a against belt 18, into engagement with or close proximity to the magnetic brush. Alternatively, the magnetic brush may be moved toward belt 18 to selectively engage belt 18. In either case, charged toner particles on the magnetic brush are selectively attracted to the latent image patterns present on belt 18, developing those image patterns. As the exposed photoconductor passes the developing station, toner is attracted to pixel locations of the photoconductor and as a result, a pattern of toner corresponding to the image to be printed appears on the photoconductor, thereby forming a developed image on the electrostatic image. As known in the art, conductor portions of development station 35, such as conductive applicator cylinders, are biased to act as electrodes. The electrodes are connected to a variable supply voltage, which is regulated by programmable controller 40 in response to LCU 24, by way of which the development process is controlled.

Development station 35 may contain a two component developer mix which comprises a dry mixture of toner and carrier particles. Typically the carrier preferably comprises high coercivity (hard magnetic) ferrite particles. As an example, the carrier particles have a volume-weighted diameter of approximately 30μ. The dry toner particles are substantially smaller, on the order of 6μ to 15μ in volume-weighted diameter. Development station 35 may include an applicator having a rotatable magnetic core within a shell, which also may be rotatably driven by a motor or other suitable driving means. Relative rotation of the core and shell moves the developer through a development zone in the presence of an electrical field. In the course of development, the toner selectively electrostatically adheres to photoconductive belt 18 to develop the electrostatic images thereon and the carrier material remains at development station 35. As toner is depleted from the development station due to the development of the electrostatic image, additional toner is periodically introduced by toner auger 42 into development station 35 to be mixed with the carrier particles to maintain a uniform amount of development mixture. Toner auger 42 is driven by a replenisher motor 41 controlled by a replenisher motor control 43. This development mixture is controlled in accordance with various development control processes. Single component developer stations, as well as conventional liquid toner development stations, may also be used.

A transfer station 46 in printing machine 10 moves a receiver sheet S into engagement with photoconductive belt 18, in registration with a developed image to transfer the developed image to receiver sheet S. Receiver sheets S may be plain or coated paper, plastic, or another medium capable of being handled by printer machine 10. Typically, transfer station 46 includes a charging device for electrostatically biasing movement of the toner particles from belt 18 to receiver sheet S. In this example, the biasing device is roller 46*b*, which engages the back of sheet S and which is connected to programmable voltage controller 46*a* that operates in a constant current mode during transfer. Alternatively, an intermediate member may have the image transferred to it and the image may then be transferred to receiver sheet S. After transfer of the toner image to receiver sheet S, sheet S is detacked from belt 18 and transported to fuser station 49 where the image is fixed onto sheet S, typically by the application of heat. Alternatively, the image may be fixed to sheet S at the time of transfer. The fuser station 49 implements the one or more of apparatus and processes previously described in relation FIGS. 1–12. A fuser entry guide may be implemented between the transfer station 46 and the fuser station, for example, as described in U.S. patent application Ser. No. 10/668,416 filed Sep. 23, 2003, in the names of John Giannetti, Giovanni B. Caiazza, and Jerome F. Sleve, the contents of which are incorporated by reference as if fully set forth herein.

A cleaning station 48, such as a brush, blade, or web is also located behind transfer station 46, and removes residual toner from belt 18. A pre-clean charger (not shown) may be located before or at cleaning station 48 to assist in this cleaning. After cleaning, this portion of belt 18 is then ready for recharging and re-exposure. Of course, other portions of belt 18 are simultaneously located at the various workstations of printing machine 10, so that the printing process is carried out in a substantially continuous manner.

LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to printing machine 10, or received from sources external to printing machine 10, such from as a human user or a network control. The output data and control signals from LCU 24 are applied directly or through storage latches to suitable output drivers and in turn to the appropriate subsystems within printing machine 10.

Process control strategies generally utilize various sensors to provide real-time closed-loop control of the electrostatographic process so that printing machine 10 generates "constant" image quality output, from the user's perspective. Real-time process control is necessary in electrographic printing, to account for changes in the environmental ambient of the photographic printer, and for changes in the operating conditions of the printer that occur over time during operation (rest/run effects). An important environmental condition parameter requiring process control is relative humidity, because changes in relative humidity affect the charge-to-mass ratio Q/m of toner particles. The ratio Q/m directly determines the density of toner that adheres to the photoconductor during development, and thus directly affects the density of the resulting image. System changes that can occur over time include changes due to aging of the printhead (exposure station), changes in the concentration of magnetic carrier particles in the toner as the toner is depleted through use, changes in the mechanical position of primary charger elements, aging of the photoconductor, variability in the manufacture of electrical components and of the photoconductor, change in conditions as the printer warms up after power-on, triboelectric charging of the toner, and other changes in electrographic process conditions. Because of these effects and the high resolution of modern electrographic printing, the process control techniques have become quite complex.

Process control sensor may be a densitometer 76, which monitors test patches that are exposed and developed in non-image areas of photoconductive belt 18 under the control of LCU 24. Densitometer 76 may include a infrared or visible light LED, which either shines through the belt or is reflected by the belt onto a photodiode in densitometer 76. These toned test patches are exposed to varying toner density levels, including full density and various intermediate densities, so that the actual density of toner in the patch can be compared with the desired density of toner as indicated by the various control voltages and signals. These densitometer measurements are used to control primary charging voltage $V_O$, maximum exposure light intensity $E_O$, and development station electrode bias $V_B$. In addition, the process control of a toner replenishment control signal value or a toner concentration setpoint value to maintain the charge-to-mass ratio Q/m at a level that avoids dusting or hollow character formation due to low toner charge, and also avoids breakdown and transfer mottle due to high toner charge for improved accuracy in the process control of printing machine 10. The toned test patches are formed in the interframe area of belt 18 so that the process control can be carried out in real time without reducing the printed output throughput. Another sensor useful for monitoring process parameters in printer machine 10 is electrometer probe 50, mounted downstream of the corona charging station 28 relative to direction P of the movement of belt 18. An example of an electrometer is described in U.S. Pat. No. 5,956,544 incorporated herein by this reference.

Other approaches to electrographic printing process control may be utilized, such as those described in International Publication Number WO 02/10860 A1, and International Publication Number WO 02/14957 A1, both commonly assigned herewith and incorporated herein by this reference.

Raster image processing begins with a page description generated by the computer application used to produce the desired image. The Raster Image Processor interprets this page description into a display list of objects. This display list contains a descriptor for each text and non-text object to be printed; in the case of text, the descriptor specifies each text character, its font, and its location on the page. For example, the contents of a word processing document with styled text is translated by the RIP into serial printer instructions that include, for the example of a binary black printer, a bit for each pixel location indicating whether that pixel is to be black or white. Binary print means an image is converted to a digital array of pixels, each pixel having a value assigned to it, and wherein the digital value of every pixel is represented by only two possible numbers, either a one or a zero. The digital image in such a case is known as a binary image. Multi-bit images, alternatively, are represented by a digital array of pixels, wherein the pixels have assigned values of more than two number possibilities. The RIP renders the display list into a "contone" (continuous tone) byte map for the page to be printed. This contone byte map represents each pixel location on the page to be printed by a density level (typically eight bits, or one byte, for a byte map rendering) for each color to be printed. Black text is generally represented by a full density value (255, for an eight bit rendering) for each pixel within the character. The byte map typically contains more information than can be used by the printer. Finally, the RIP rasterizes the byte map into a bit map for use by the printer. Half-tone densities are formed by the application of a halftone "screen" to the byte map, especially in the case of image objects to be printed. Pre-press adjustments can include the selection of the particular halftone screens to be applied, for example to adjust the contrast of the resulting image.

Electrographic printers with gray scale printheads are also known, as described in International Publication Number WO 01/89194 A2, incorporated herein by this reference. As described in this publication, the rendering algorithm groups adjacent pixels into sets of adjacent cells, each cell corresponding to a halftone dot of the image to be printed. The gray tones are printed by increasing the level of exposure of each pixel in the cell, by increasing the duration by way of which a corresponding LED in the printhead is kept on, and by "growing" the exposure into adjacent pixels within the cell.

Ripping is printer-specific, in that the writing characteristics of the printer to be used are taken into account in producing the printer bit map. For example, the resolution of the printer both in pixel size (dpi) and contrast resolution (bit depth at the contone byte map) will determine the contone byte map. As noted above, the contrast performance of the printer can be used in pre-press to select the appropriate halftone screen. RIP rendering therefore incorporates the attributes of the printer itself with the image data to be printed.

The printer specificity in the RIP output may cause problems if the RIP output is forwarded to a different electrographic printer. One such problem is that the printed image will turn out to be either darker or lighter than that which would be printed on the printer for which the original RIP was performed. In some cases the original image data is not available for re-processing by another RIP in which tonal adjustments for the new printer may be made.

Processes for developing electrostatic images using dry toner are well known in the art. The term "electrographic printer," is intended to encompass electrophotographic printers and copiers that employ a photoconductor element, as well as ionographic printers and copiers that do not rely upon a photoconductor.

Electrographic printers typically employ a developer having two or more components, consisting of resinous, pigmented toner particles, magnetic carrier particles and other components. The developer is moved into proximity with an electrostatic image carried on an electrographic imaging member, whereupon the toner component of the developer is transferred to the imaging member, prior to being transferred to a sheet of paper to create the final image. Developer is moved into proximity with the imaging member by an electrically-biased, conductive toning shell, often a roller that may be rotated co-currently with the imaging member, such that the opposing surfaces of the imaging member and toning shell travel in the same direction. Located adjacent the toning shell is a multipole magnetic core, having a plurality of magnets, that may be fixed relative to the toning shell or that may rotate, usually in the opposite direction of the toning shell. The developer is deposited on the toning shell and the toning shell rotates the developer into proximity with the imaging member, at a location where the imaging member and the toning shell are in closest proximity, referred to as the "toning nip."

According to a further aspect of the invention a process is provided, comprising forming an electrostatic image on an imaging member, forming a developed image on the electrostatic image, moving a print medium past the imaging member, transferring the developed image to the print medium, moving the print medium through a fusing nip comprising a fusing force, and changing the fusing force while the print medium is moving through the fusing nip. This process may be carried out while the print medium is contacting the imaging member during transfer of the developed image to the print medium and while the print medium is moving through the fusing nip. As previously described, smearing of the image proximate the trailing edge of the print medium may be avoided.

Although certain aspects of the invention have been described with external heat sources, such as heater rollers 110 and 111, internal heat sources may be implemented as well, for example inside rollers 104 and/or 106 instead of or in addition to one or more external heat sources.

It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements have been described as being implemented by software, in other embodiments hardware or firmware implementations may alternatively be used, and vice-versa. Similarly, the controllers may implement software, hardware, and/or firmware. In view of the wide variety of embodiments to which the principles of the present invention can be applied, it should be understood that the illustrated embodiments are exemplary only, and should not be taken as limiting the scope of the present invention.

The claims should not be read as limited to the described order or elements unless stated to that effect. In addition, use of the term "means" in any claim is intended to invoke 35 U.S.C. §112, paragraph 6, and any claim without the word "means" is not so intended.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

PARTS LIST

IDB image data bus
LE leading edge of the print medium
LED light of emitting diodes
MIP marking image processor
MSS marking subsystem services
P arrow
PDL page description language
S receiver sheet
TE trailing edge of the print medium
10 printer machine
18 belt or photoconductive belt
18*a* surface
20 motor
21*a* through 21*g* plurality of roller or other supports
24 logic and control (LCU)
28 charging station
30 programmable voltage controller
32 writer interface
34 exposure station 34
34*a* writer
35 development station
35*a* moving backup roller or bar
36 image data source
37 raster image processor (RIP) 37
38 marking image processor (MIP)
39 render
40 programmable controller
41 replenisher motor
42 toner auger
43 replenisher motor control
46 transfer station
46*a* programmable voltage controller
46*b* roller

48 cleaning station
49 fuser station
50 electrometer probe
57 sensor
76 densitometer
100 fusing apparatus
102 fusing nip
104 roller
106 roller
108 heating nip
109 heating nip
110 heater roller
111 another heater roller
112 heat source
113 another heat source
114 first temperature sensor
116 second temperature sensor
117 third temperature sensor
118 controller
120 roller temperature
122 heater roller temperature
123 another heater roller temperature
124 standby
126 run
128 temperature plot
130 temperature plot
132 temperature plot
134 temperature plot
200 fusing apparatus
202 fuser assembly
204 thickness sensor
206 print media thickness
208 heat source
210 print media
218 controller
300 fusing apparatus
310 heater roller
311 another heater roller
312 heat source
313 another heat source
318 controller
320, 322, 324 three heating powers
330, 332, 334 three print media widths
336 first print media width
338 second print media width
340 heater roller width
342 another heater roller width
344 another heating power
346 first heating power
348 second heating power
400 apparatus
402 multiplexer
404 thermistor amplifier board
406 digital converter
408 feedback controller
410 feed forward controller
412 analog to digital converter
414 a first solid state relay
416 second solid state relay
418 distributed cotnroller
420 multiplexer
500 fusing apparatus
502 fuser assembly
504 print media
505 print medium
506 controller
508 fusing nip loading mechanism
510 lever
512 fixed pivot
514 pivot
516 actuator
518 interframe gap

The invention claimed is:

1. A fusing process, comprising:

fusing a print media in a fusing nip comprising two rollers;

heating a heater roller in contact with a first roller with a heat source;

controlling a heating power for the heat source dependent upon a print media width, comprising at least three heating powers corresponding to at least three print media widths; and heating another heater roller in contact with the first roller, and controlling another heating power for another heat source not dependent upon the print media width.

2. The process of claim 1, comprising the another heater roller comprising the another heat source.

3. The process of claim 1, the fusing nip being part of a fusing assembly for an electrographic printer.

4. The process of claim 1, comprising increasing the heating power with an increase in print media width.

5. The process of claim 1, comprising decreasing the heating power with a decrease in print media width.

6. The process of claim 1, further comprising changing a fusing force while the print media is moving through the fusing nip.

7. A fusing apparatus for an electrographic printer, comprising:

a fusing nip comprising two rollers;

a heating nip comprising a heater roller and a first roller, the heater roller comprising a heat source comprising an operable width;

another heating nip comprising another heater roller and the first roller, the another heater roller comprising another heat source comprising another operable width, the operable width being greater than the another operable width;

a controller operative to establish a heating power for the heat source dependent upon a print media width, comprising at least three heating powers corresponding to at least three print media widths, the controller being operative to establish another heating power for the another heat source not dependent upon the print media width.

8. The apparatus of claim 7, the controller being operative to linearly increase the heating power with an increase in print media width from a first print media width to a greater second print media width.

9. The apparatus of claim 7, the controller being operative to linearly decrease the heating power with a decrease in print media width from a second print media width to a lesser first print media width.

* * * * *